US006594871B2

(12) United States Patent
Hoffman

(10) Patent No.: US 6,594,871 B2
(45) Date of Patent: Jul. 22, 2003

(54) JEWELRY WITH REPLACEABLE ORNAMENTATION

(76) Inventor: Leslie C. Hoffman, 10445 Wilshire Blvd., Penthouse, Westwood, CA (US) 90024

( * ) Notice: Subject to any disclaimer, the term of this patent is extended or adjusted under 35 U.S.C. 154(b) by 0 days.

(21) Appl. No.: 10/006,541

(22) Filed: Nov. 30, 2001

(65) Prior Publication Data

US 2002/0112322 A1 Aug. 22, 2002

Related U.S. Application Data

(63) Continuation-in-part of application No. 09/487,424, filed on Jan. 20, 2000, now Pat. No. 6,363,584.

(51) Int. Cl.[7] ..... A44B 21/00; E05B 47/02

(52) U.S. Cl. ..... 24/303; 24/66.1; 24/102 R; 24/114.9; 24/499; 40/1.5; 292/251.5

(58) Field of Search ..... 24/303, 66.1, 90.1, 24/102 R, 102 T, 114.3, 114.9, 114.11, 499; 40/1.5; 292/251.5

(56) References Cited

U.S. PATENT DOCUMENTS

| | | | | | |
|---|---|---|---|---|---|
| 2,197,882 | A | | 4/1940 | Simpson | |
| 2,597,887 | A | | 5/1952 | Meeker | |
| 2,615,227 | A | | 10/1952 | Hornik | |
| 2,659,169 | A | | 11/1953 | Brennan | |
| 2,752,764 | A | | 7/1956 | Lederer | |
| 2,860,395 | A | | 11/1958 | Anderson | |
| 3,034,320 | A | | 5/1962 | Feibelman | |
| 3,041,697 | A | | 7/1962 | Budreck | |
| 3,071,939 | A | | 1/1963 | Feibelman | |
| 3,129,477 | A | | 4/1964 | Mizuno | |
| 3,326,587 | A | * | 6/1967 | Reiss | 24/303 |
| 3,509,734 | A | | 5/1970 | Lederer | |
| 3,639,949 | A | | 2/1972 | Beck | |
| 3,670,525 | A | | 6/1972 | Mulligan | |
| 3,813,732 | A | | 6/1974 | Seavey | |
| 4,052,864 | A | | 10/1977 | Hofsaess | |
| 4,231,137 | A | | 11/1980 | Fujimoto | |
| D263,765 | S | | 4/1982 | Engelhardt | |
| 4,425,771 | A | * | 1/1984 | Beach et al. | 292/251.5 |
| 4,536,732 | A | | 8/1985 | Schindl et al. | |
| 4,604,819 | A | * | 8/1986 | Grey | 40/1.5 |
| 4,912,944 | A | | 4/1990 | Crosley et al. | |
| 4,957,316 | A | * | 9/1990 | Frolov | 292/251.5 |
| 4,982,581 | A | * | 1/1991 | Furuyama | 24/303 |
| 5,036,681 | A | | 8/1991 | Schaerer | |
| 5,050,276 | A | | 9/1991 | Pemberton | |
| 5,099,659 | A | | 3/1992 | Carranza et al. | |
| 5,195,335 | A | | 3/1993 | Hart | |
| 5,367,891 | A | | 11/1994 | Furuyama | |
| 5,432,986 | A | * | 7/1995 | Sexton | 24/303 |
| 5,508,070 | A | * | 4/1996 | DiLapo et al. | 428/24 |
| 5,535,603 | A | | 7/1996 | Hayakawa | |
| 5,806,346 | A | | 9/1998 | Schlinger et al. | |
| 5,845,373 | A | | 12/1998 | Langer | |
| 6,282,760 | B1 | * | 9/2001 | Mars | 24/303 |

* cited by examiner

*Primary Examiner*—Victor Sakran
(74) *Attorney, Agent, or Firm*—Fulbright & Jaworski, LLP

(57) ABSTRACT

A jewelry element includes a magnetic arrangement for ready substitution of multiple decorative elements. The element, which may be incorporated into a number of common jewelry pieces including a cuff link, earring, a stud for a tuxedo shirt, a ring or an pendant, includes a frame having a recessed central portion for receiving a decorative element. A pair of magnets is press-fit within a circular slot at the bottom of the recess and another magnet is adhesively-fixed to the bottom of the decorative element. An aperture in the bottom of the recessed portion of the frame provides access for a stylus for selectively dislodging the decorative element.

8 Claims, 2 Drawing Sheets

JEWELRY WITH REPLACEABLE ORNAMENTATION

REFERENCE TO RELATED APPLICATION

The present application is a continuation-in-part of pending U.S. patent application Ser. No. 09/487,424 filed Jan. 20, 2000 now U.S. Pat. No. 6,363,584 of George Gero, Leslie Hoffman and Raymond Lathrop covering "Cuff Link With Changeable Element".

BACKGROUND

1. Field of the Invention

The present invention relates to jewelry. More particularly, this invention pertains to jewelry, such as cuff links, studs for tuxedo shirts, rings, earrings and pendants, that includes an interchangeable design feature.

2. Description of the Prior Art

High fashion, elegant jewelry such as cuff links, studs for tuxedo shirts, rings, earrings and pendants, enjoy a limited market due to their expense. This is particularly unfortunate as jewelry is most striking when closely matched to the wearer's other apparel and accessories (e.g. tie and/or handkerchief).

In order to expand the consumer market for such jewelry, attempts have been made to introduce the concept of interchangeability into the high-end market. To date, such attempts have involved either relatively-complex or difficult-to-handle mechanisms.

SUMMARY OF THE INVENTION

The present invention addresses the preceding and other shortcomings of the prior art by providing a jewelry element that includes a frame. Such frame includes a recessed central portion. An ornamental element is shaped to be received within the recessed portion of the frame.

A first magnet is fixed to the bottom of the ornamental element and at least one other magnet is fixed to and arranged with the recessed portion of the frame to secure the ornamental element to the frame. An aperture through the bottom of the recessed portion of the frame provides access for a stylus for selectively dislodging the ornamental element from the frame.

The preceding and other features and advantages of the present invention will be further apparent from the detailed description that follows. Such description is accompanied by a set of drawing figures. Numerals of the drawing figures, corresponding to those of the written description, point to the various features of the invention with like numerals referring to like features throughout both the written description and the drawing figures.

BRIEF DESCRIPTION OF THE DRAWING FIGURES

DETAILED DESCRIPTION OF THE PREFERRED EMBODIMENT

Figure 1:
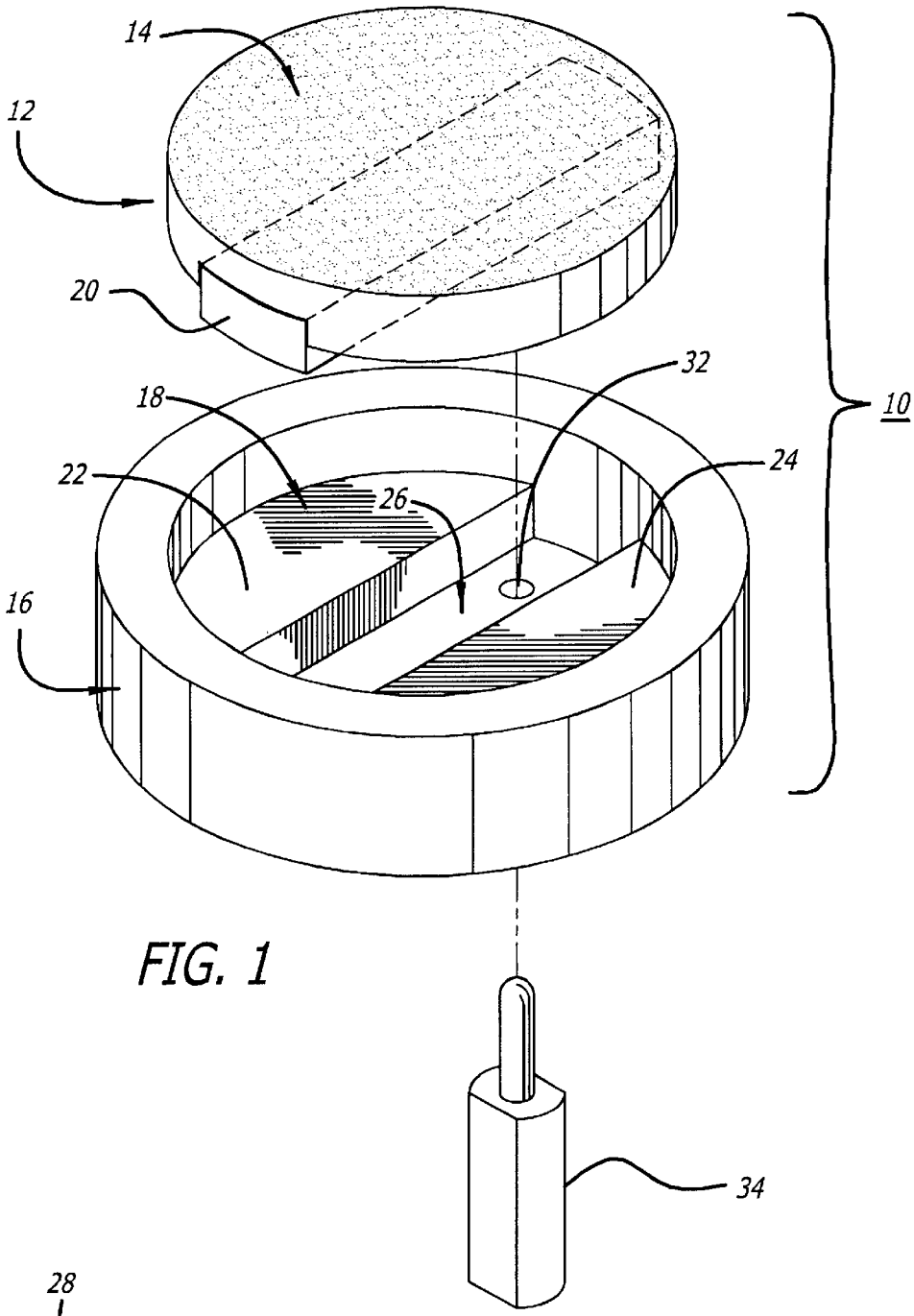
FIG. 1 is an exploded perspective view of a jewelry element in accordance with the invention.

Turning to the drawings, FIG. 1 is an exploded perspective view of a jewelry element 10 in accordance with the invention. The jewelry element 10 comprises a replaceable ornamental element 12 having a decorative exterior surface 14 and a frame 16. It is a central feature of the invention that the replaceable ornamental element 12 is readily removable yet securely fixed when. engaged to allow the ready substitution of another element having an exterior surface of different decorative character. In this way, the element 10 may be simply and rapidly reconfigured to present multiple design effects. Such multiple effects may, for example, be undertaken for the purpose of matching the appearance of the jewelry element 10, which may be incorporated into a cuff link, an earring, a stud for a tuxedo shirt, a ring or a pendant to the wearer's apparel and/or accessories.

The frame 16 is shown is shown to be generally circular although the invention is not so limited and may include other frame geometries, including square, rectangular or polygonal. A centrally-located recess 18 is provided within the frame 16 for receiving the replaceable ornamental element 12. While the element 12 is shown to be disk-like, it, too, may be of a number of shapes for providing a desired appearance when combined with the frame 16.

The element 12 may comprise a gemstone, a metallic medallion, or a composite ornamentation that might integrate a gem with a metallic setting. A first magnet 20 is adhesively fixed (e.g. by EPOXY) to the bottom surface of the ornamental element 12. The first magnet 20 is generally-planar with opposed major surfaces of opposite magnetic polarity. For example, the top surface of the first magnet 20, which is adhesively fixed to the bottom surface of the replaceable ornamental element 12, may be the south pole of the magnet 20 while the opposed major surface (i.e., the bottom surface of the first magnet 20) is its north pole. The reverse arrangement, with the top surface of the first magnet 20 comprising the north pole and the bottom surface comprising the south pole may be also be accommodated by an arrangement in accordance with the invention.

Figure 2:
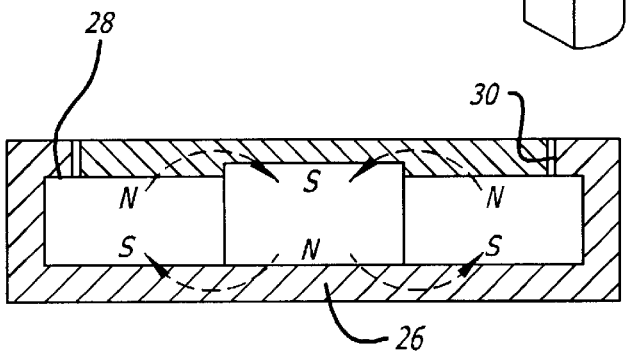
FIG. 2 is a side sectional view of the jewelry element of the invention.
Figure 3A:
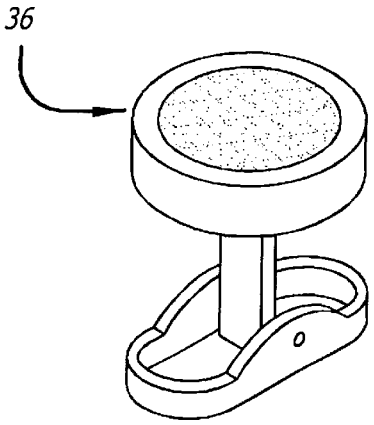
FIGS. 3(*a*) through 3(*e*) are a series of figures illustrating the present invention adapted for use in a cuff link, earring, stud for a tuxedo shirt, ring and pendant respectively.
Figure 3B:
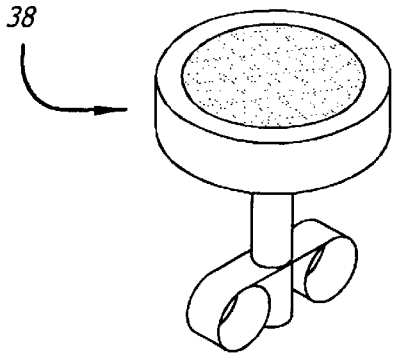
Figure 3C:
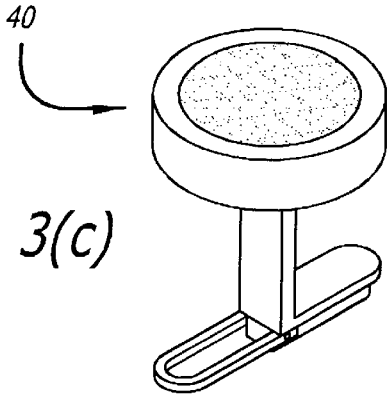
Figure 3D:
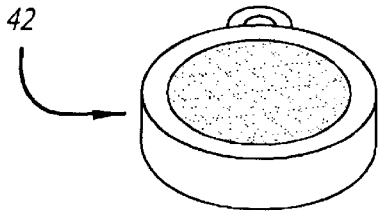
Figure 3E:
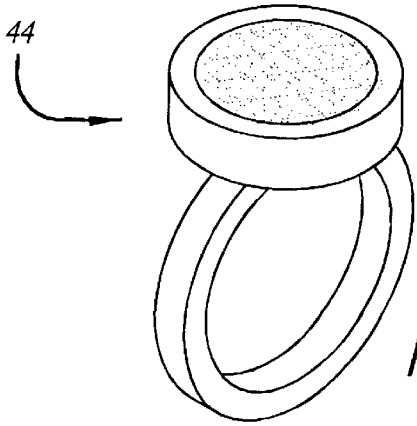

FIG. 2 is a cross-sectional view of the invention, with the ornamental element 12 "in place", taken at line 2—2 of FIG. 1. Viewing FIGS. 1 and 2 in combination, a pair of magnets 22, 24 is seen to be fixed to the bottom 26 of the recess 18 within the frame 16. Each of the magnets 22 and 24 is fixedly held in a horizontal slot 28 within the interior surface 30 of the recess 18.

As can be seen, each of the magnets 22, 24 includes an arcuate edge and a straight edge to accommodate the circular horizontal slot 28 while permitting alignment with the straight side edges of the first magnet 20. Other geometries may be suitable for the magnets 22, 24 depending, in part, upon the geometry of the horizontal slot 28 which may or may not follow that of the frame 16.

As in the case of the first magnet 20, each of the pair of magnets 22 and 24 is generally-planar and polarized so that its major planar surfaces are of opposite polarities. As illustrated in FIG. 2, each of the magnets is fixed within the recess 18 with its surface of south polarity contacting the bottom 26 of the recess 16 and its surface of north polarity facing upwardly. In contrast, the first magnet 20 is oppositely-fixed to the bottom of the ornamental element 12 so that its south pole surface is fixed to the overlying element 12 and its north pole faces downwardly. This arrangement allows the lines of magnet flux associated with the magnets 20, 22 and 24 to travel through the metallic frame as shown. Such continuity of flux assures that, upon insertion of the ornamental element 12 into the recess 18 of the frame 16, the element 12 is held securely therein.

An aperture 32 in the bottom 26 of the frame 16 between the facing magnets 22 and 24 provides access for a stylus 34 for dislodging the ornamental element 12. This will occur when the user desires to change the appearance of the jewelry element 10. Once the ornamental element 12 has been dislodged, another ornamental element 12 with different surface decoration 14 but including a like magnet arrangement at its bottom (unseen) surface may be inserted into the recess 18 with magnetic forces again retaining the new ornamentation.

The ability to change decorative appearance permits the jewelry element 10 to enhance numerous common types of jewelry. FIGS. 3(*a*) through 3(*e*) are a series of perspective views of jewelry, including a cufflink 36, an earring 38, a stud 40 for a tuxedo, a pendant 42 and a ring 44 respectively, each incorporating a jewelry element in accordance with the invention. In each instance the jewelry element 10 forms the central decorative element of the piece and affords that piece the advantages of interchangeability that multiplies its desirability.

Thus, it is seen that the present invention provides a jewelry element suitable for and capable of matching numerous types of apparel and accessories. As the invention relies upon the substitution of a design element to alter the appearance of, for example, a cuff link, a stud for a tuxedo shirt, a ring or a pendant, the wearer has the freedom to test a number of "looks" without undergoing multiple tedious insertion and removal processes.

While this invention has been described with reference to its presently-preferred embodiment, it is not limited thereto.

What is claimed is:

1. A jewelry element comprising, in combination:

a) a frame;

b) said frame comprising a recessed central portion;

c) a decorative element to be received within said recessed portion of said frame;

d) a first magnet fixed to the bottom of said decorative element;

e) at least one other magnet being fixed to and arranged within said recessed portion of said frame for securing said decorative element therewithin; and f) an aperture extending through the bottom of said recessed portion of said frame for providing access for a stylus for selectively dislodging said decorative element from said frame.

2. A jewelry element as defined in claim 1 wherein said first magnet is adhesively fixed to the bottom of said decorative element.

3. A jewelry element comprising, in combination:

a) a frame;

b) said frame comprising a recessed central portion;

c) a decorative element to be received within said recessed portion of said frame;

d) a first magnet fixed to the bottom of said decorative element;

e) a pair of magnets fixed to and arranged within said recessed portion of said frame;

f) a separation distance exists between said pair of magnets;

g) said first magnet being arranged to fit within said separation distance when said decorative element is received within said recessed portion; and h) an aperture extending through the bottom of said recessed portion of said frame for providing access for a stylus for selectively dislodging said decorative element from said frame.

4. A jewelry element as defined in claim 3 wherein each of said pair of magnets is press-fit within said recessed portion of said frame.

5. A jewelry element as defined in claim 3 wherein:

a) each of said magnets has opposed major planar surfaces;

b) one of said major planar surfaces of said first magnet is fixed to the bottom of said decorative element; and c) one of said major planar surfaces of each of said pair of magnets contacts the bottom of said recessed portion of said frame.

6. A jewelry element as defined in claim 5 further characterized in that;

a) said opposed major planar surfaces of each of said magnets are of opposite magnetic polarity; and b) said planar major surfaces of said pair of magnets that contact said bottom of said recessed portion of said frame are of the same magnetic polarity as said planar major surface of said first magnet that is fixed to the bottom of said decorative element.

7. A jewelry element as defined in claim 6 wherein:

a) said frame is generally disk-shaped; and b) said central recess is generally disk-shaped and concentric with said frame.

8. A jewelry element as defined in claim 7 further including a circular slot at the bottom of said central recess for receiving each of said pair of magnets in press-fit relationship.

* * * * *